US008206275B2

(12) United States Patent
Chang

(10) Patent No.: US 8,206,275 B2
(45) Date of Patent: Jun. 26, 2012

(54) BALANCE TRAINING DEVICE

(76) Inventor: Chih-Hao Chang, Chiayi (TW)

( * ) Notice: Subject to any disclaimer, the term of this patent is extended or adjusted under 35 U.S.C. 154(b) by 57 days.

(21) Appl. No.: 12/819,364

(22) Filed: Jun. 21, 2010

(65) Prior Publication Data

US 2011/0098164 A1 Apr. 28, 2011

(30) Foreign Application Priority Data

Oct. 22, 2009 (TW) ..... 98219507 U

(51) Int. Cl.
*A63B 22/14* (2006.01)

(52) U.S. Cl. ..... 482/146; 472/4

(58) Field of Classification Search ..... 482/34, 482/79, 80, 140, 141, 142, 146, 147, 148, 482/52; 434/247, 250, 255, 258; 601/23, 601/27, 32, 34, 42; 472/4, 106, 107, 108, 472/109, 111, 112, 113, 115; 119/702, 703, 119/705

See application file for complete search history.

(56) References Cited

U.S. PATENT DOCUMENTS

D158,703 S * 5/1950 Westcamp ..... D21/412
3,361,427 A * 1/1968 Paves ..... 482/146
4,759,542 A * 7/1988 Hudec ..... 482/34
5,037,084 A * 8/1991 Flor ..... 482/52
5,108,089 A * 4/1992 Wilkinson ..... 482/52
5,152,691 A * 10/1992 Moscarello ..... 434/247
5,269,735 A * 12/1993 Pfitzenmeier ..... 482/52
5,318,489 A * 6/1994 Irwin ..... 482/52
5,328,421 A * 7/1994 Stanalajczo ..... 482/34
5,545,115 A * 8/1996 Corcoran ..... 482/146
5,620,404 A * 4/1997 Eyman ..... 482/142
5,645,511 A * 7/1997 Le Roux et al. ..... 482/52
7,112,168 B2 * 9/2006 Dalebout et al. ..... 482/146
7,479,097 B2 * 1/2009 Rosborough et al. ..... 482/146
2006/0270536 A1 11/2006 Tukada

* cited by examiner

*Primary Examiner* — Stephen Crow
*Assistant Examiner* — Tam Nguyen
(74) *Attorney, Agent, or Firm* — K&L Gates LLP

(57) ABSTRACT

A balance training device includes at least one supporting base and at least one plank member. The supporting base includes a plank connecting portion formed with a plank coupling groove that opens upwardly. The plank coupling groove includes a first groove section and a second groove section that intersects the first groove section. The plank member includes a plate portion and a rib structure disposed on a bottom face of the plate portion. The rib structure removably engages the plank coupling groove of the supporting base. The rib structure includes a first rib part to engage the first groove section and a second rib part to engage the second groove section.

12 Claims, 13 Drawing Sheets

BALANCE TRAINING DEVICE

CROSS-REFERENCE TO RELATED APPLICATION

This application claims priority of Taiwanese application no. 098219507, filed on Oct. 22, 2009.

BACKGROUND OF THE INVENTION

1. Field of the Invention

The invention relates to a balance training device, more particularly to a balance training device for playing a treading balancing game.

2. Description of the Related Art

Referring to FIGS. 1 to 4, a conventional balance training device is shown to include a wedge-shaped base 1 formed with a slot 11, a connecting block 5 that has an upright plate portion 51 retained in the slot 11 and a cylindrical post 52 extending from a top side of the upright plate portion 51, and a plank 3 formed with three spaced apart post tubes 32. When the post 52 is inserted into a middle one of the post tubes 32, the plank 3 may turn relative to the base 1 in a seesaw manner.

As shown in FIG. 3, when the post 52 is inserted into a rightmost one of the post tubes 32, the plank 3 may be used as a sloping walkway.

As shown in FIG. 4, a rectangular base 7 having two slots 71, and two cylindrical posts 72 are needed for connecting two planks 3 to form a longer sloping walkway.

Because a different base 7 is needed when it is desired to connect two planks 3 to form a longer walkway, the conventional balance training device includes a large number of discrete components that result in higher costs. Moreover, connections among the components of the conventional balance training device lack variety.

SUMMARY OF THE INVENTION

Therefore, the object of the present invention is to provide a balance training device that has a relatively simple construction and that offers a variety of assembly options when forming walkways.

According to the present invention, there is provided a balance training device that includes at least one supporting base and at least one plank member. The supporting base includes a plank connecting portion formed with a plank coupling groove that opens upwardly. The plank coupling groove includes a first groove section and a second groove section that intersects the first groove section. The plank member includes a plate portion and a rib structure disposed on a bottom face of the plate portion. The rib structure removably engages the plank coupling groove of the supporting base. The rib structure includes a first rib part to engage the first groove section and a second rib part to engage the second groove section.

According to this invention, a balance training device that has a relatively simple construction and that offers a variety of assembly options when forming walkways is obtained.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
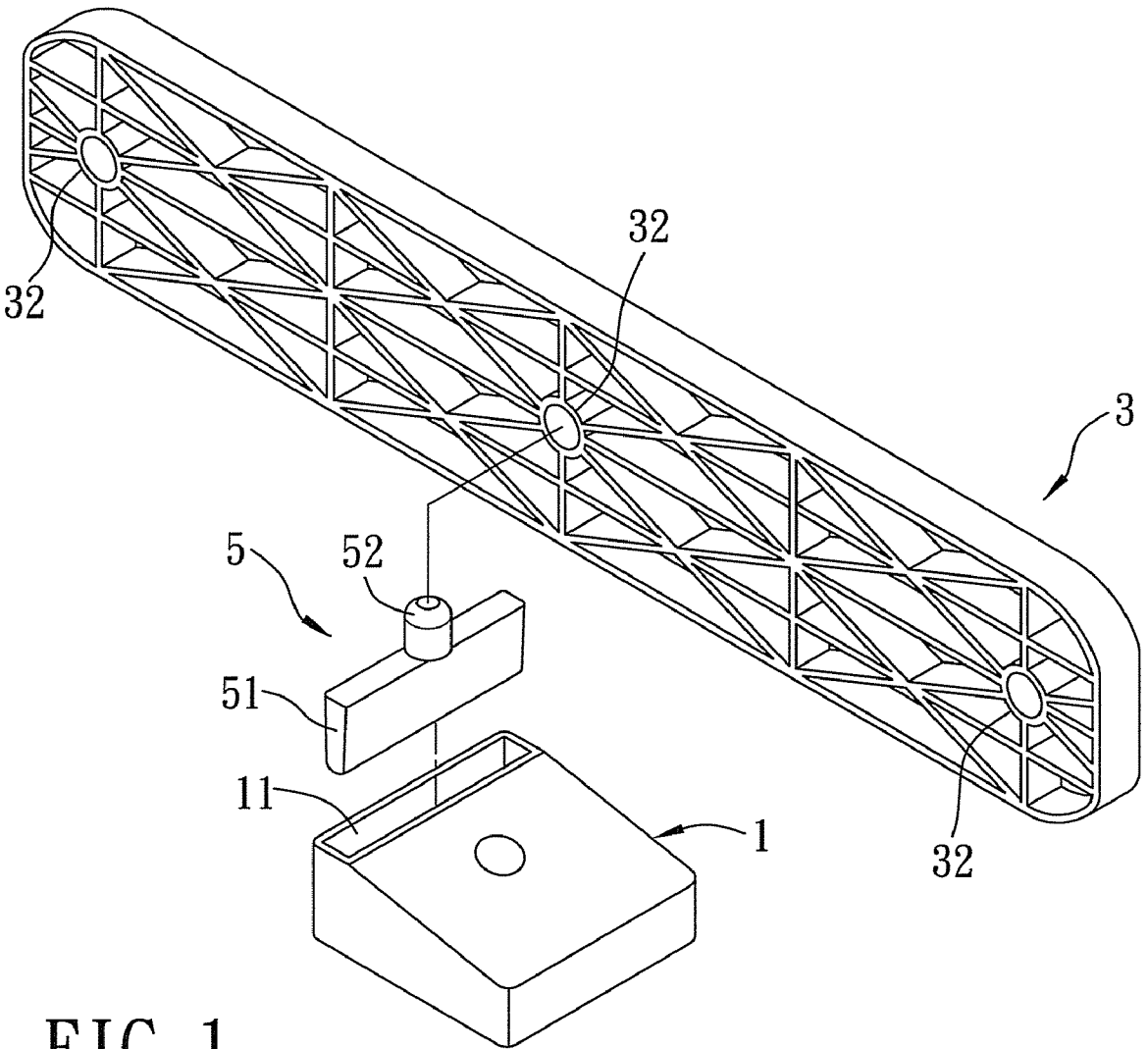
FIG. 1 PRIOR ART
FIG. 1 is an exploded perspective view of a conventional balance training device.
Figure 2:
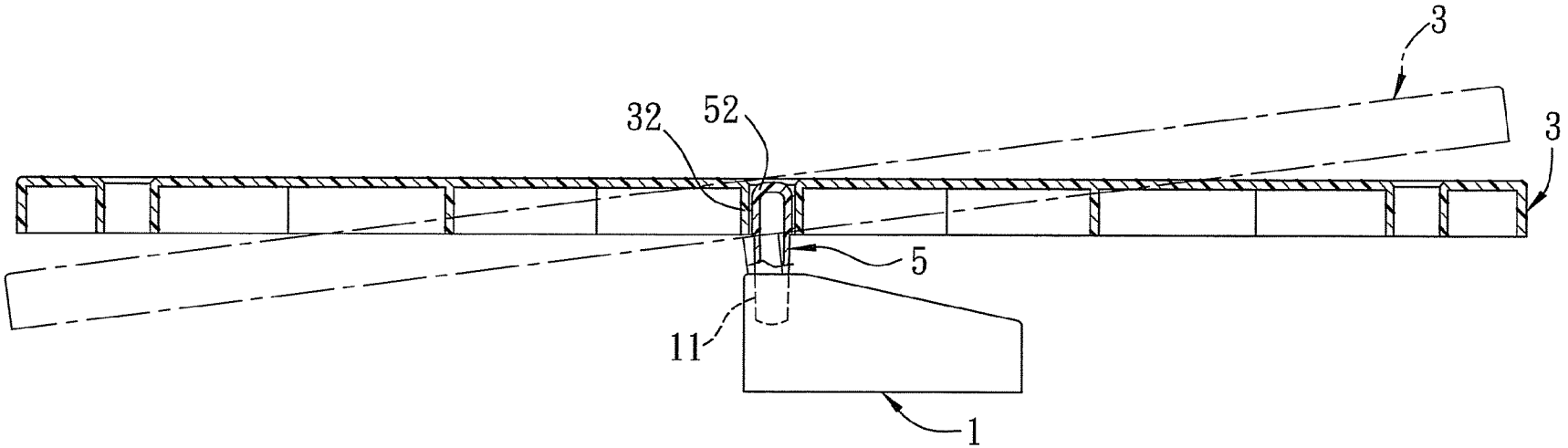
FIG. 2 PRIOR ART
FIG. 2 is an assembled partly sectional view of the conventional balance training device when assembled to form a seesaw mechanism.
Figure 3:
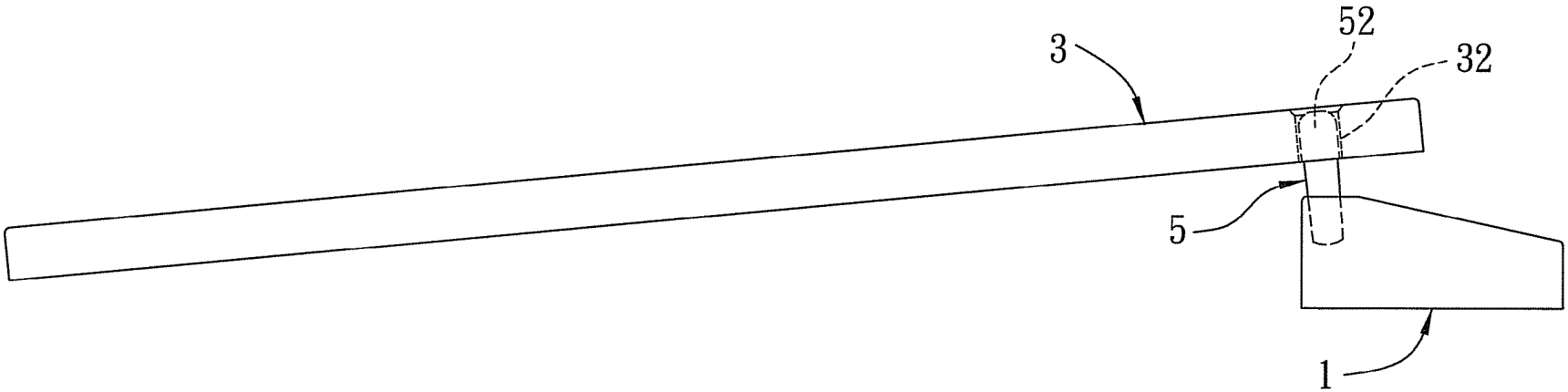
FIG. 3 PRIOR ART
FIG. 3 is a schematic side view of the conventional balance training device when assembled to form a sloping walkway.
Figure 4:
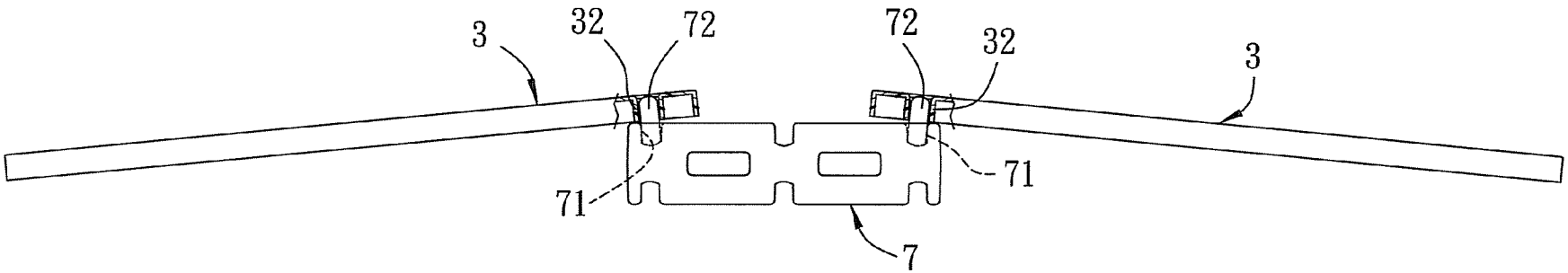
FIG. 4 PRIOR ART
FIG. 4 is a schematic partly sectional side view of the conventional balance training device when assembled to form a longer sloping walkway.
Figure 5:
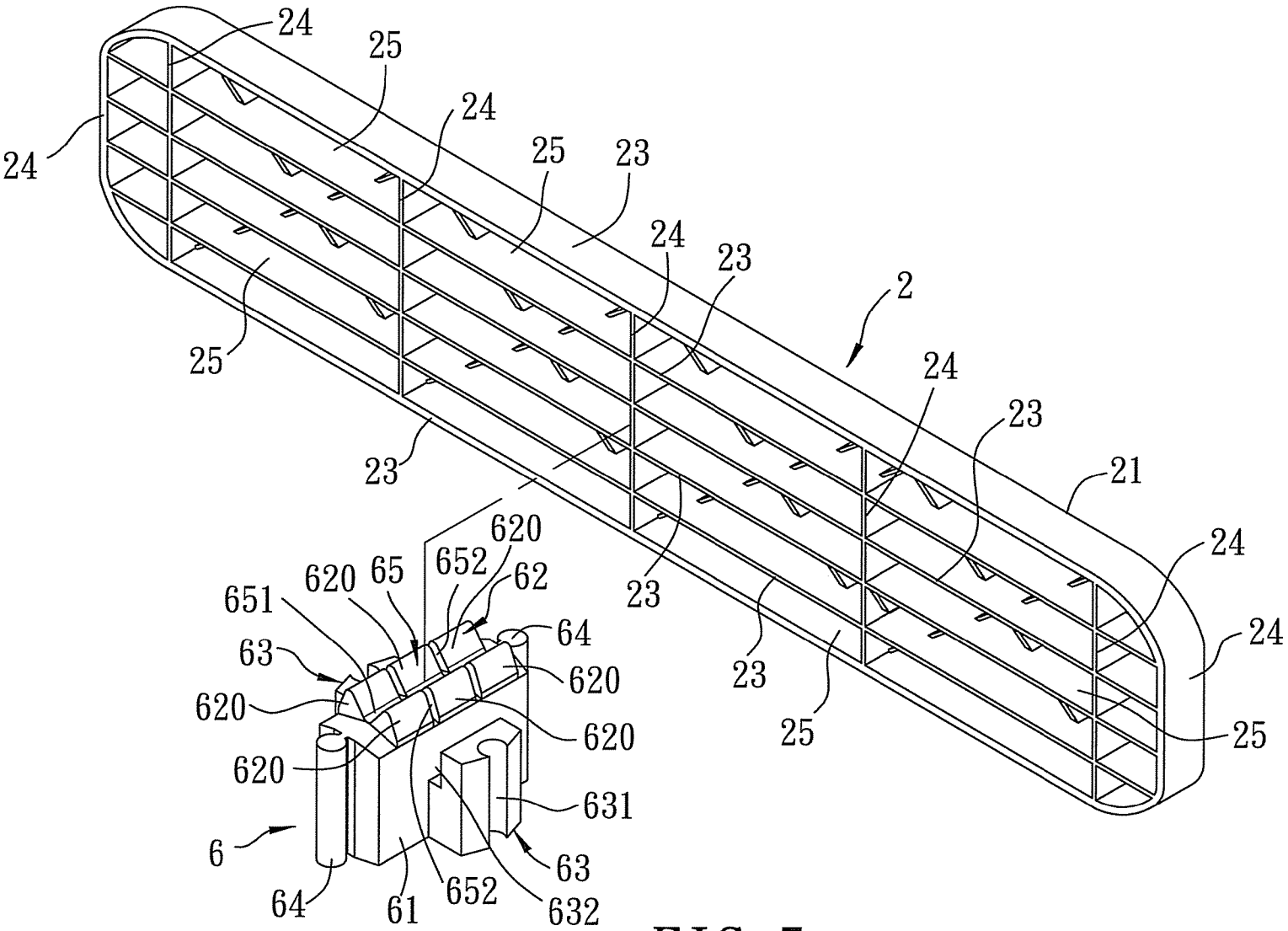
FIG. 5 is an exploded perspective view illustrating a plank member and a supporting base of the preferred embodiment of a balance training device according to the present invention.
Figure 6:
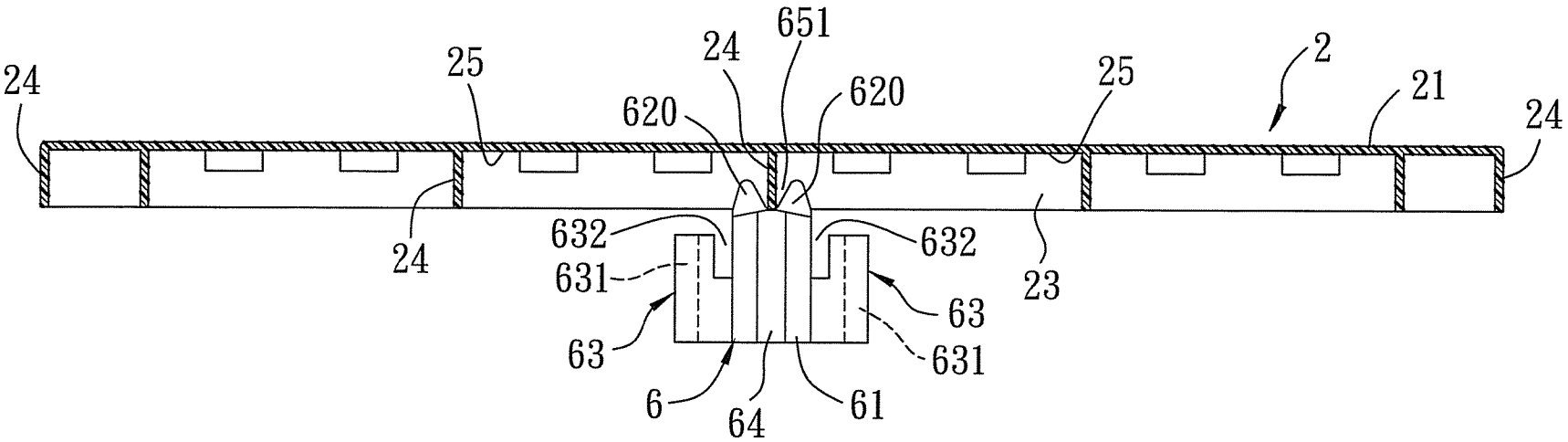
FIG. 6 is an assembled partly sectional view illustrating the plank member and the supporting base of the preferred embodiment according to the present invention when assembled to form a seesaw mechanism.

Referring to FIGS. 5 and 6, the preferred embodiment of a balance training device according to the present invention is shown to include a supporting base 6 and a plank member 2. The supporting base 6 has a plank connecting portion 62 formed with a plank coupling groove 65 that opens upwardly. The plank coupling groove 65 includes a first groove section 651 and parallel second groove sections 652 that intersect the first groove section 651. In this embodiment, the plank connecting portion 62 is formed with a plurality of projecting parts 620 arranged in a two-dimensional array that includes a plurality of rows and columns. There are six projecting parts 620 arranged in three rows and two columns in this embodiment. The first groove section 651 is defined by the projecting parts 620 in an adjacent pair of the columns. Each second groove section 652 is defined by the projecting parts 620 in an adjacent pair of the rows. In addition, each of the projecting parts 620 has an inclined inner surface that confronts the first groove section 651. The inclined inner surfaces of the projecting parts 620 configure the first groove section 651 to diverge upwardly. In other words, the first groove section 651 is a substantially V-shaped groove section.

The plank member 2 has a plate portion 21 and a rib structure disposed on a bottom face of the plate portion 21. The rib structure removably engages the plank coupling groove 65 and includes a first rib part to engage the first groove section 651 and a second rib part to engage the second groove sections 652. In this embodiment, the rib structure includes parallel first ribs 24 that serve as the first rib part and parallel second ribs 23 that serve as the second rib part. The first ribs 24 extend along a transverse direction, whereas the second ribs 23 extend along a longitudinal direction. The first ribs 24 cooperate with the second ribs 23 to form a grid that defines a plurality of grid spaces 25 to receive removably the projecting parts 620.

In this embodiment, the plate portion 21 of the plank member 2 has a pair of transverse edges connected respectively to an endmost pair of the first ribs 24, and a pair of longitudinal edges connected respectively to an endmost pair of the second ribs 23.

The plank member 2 and the supporting base 6 may be assembled as shown in FIG. 6. One of the first ribs 24 engages the first groove section 651 of the plank coupling groove 65, whereas a pair of the second ribs 23 engage the second groove sections 652 (see FIG. 5) of the plank coupling groove 65. The grid spaces 25 receive removably the projecting parts 620. The plank member 2 may turn relative to the supporting base 6 in a seesaw manner at this time.

Figure 7:
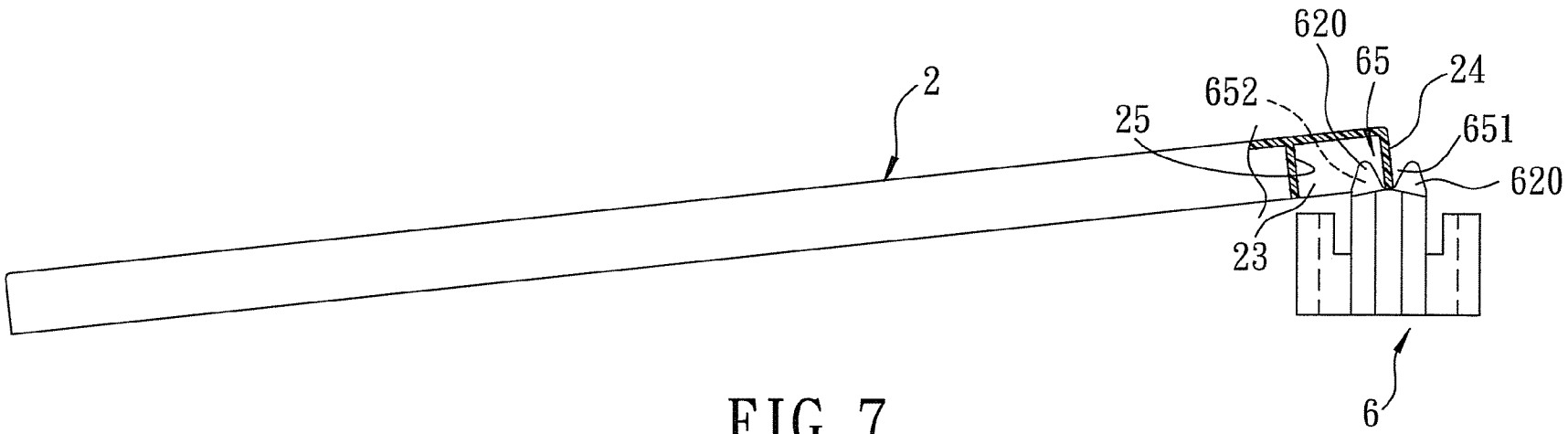
FIG. 7 is a schematic partly sectional side view illustrating the plank member and the supporting base of the preferred embodiment according to the present invention when assembled to form a sloping walkway.

As shown in FIG. 7, the preferred embodiment may also be assembled to form a sloping walkway. To form the sloping walkway, the endmost first rib 24 of the plank member 2 engages the first groove section 651 of the plank coupling groove 65. At the same time, a pair of the second ribs 23 engage left parts of the second groove sections 652 of the plank coupling groove 65. In this arrangement, the right end of the plank member 2 is propped up by the supporting base 6 to form the sloping walkway.

Figure 8:
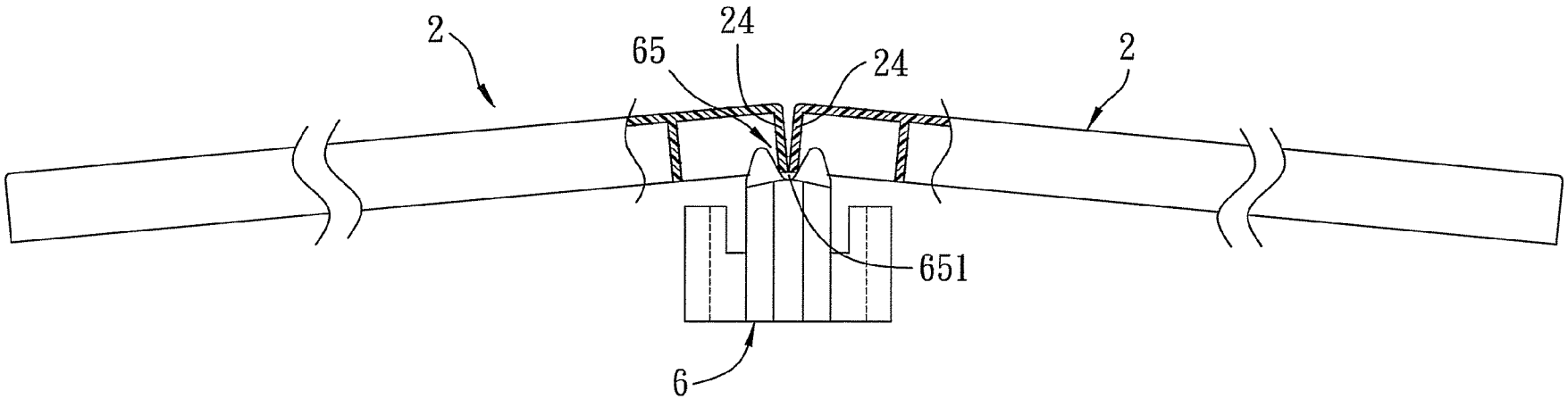
FIG. 8 is a schematic partly sectional side view illustrating two plank members and the supporting base of the preferred embodiment according to the present invention when assembled to form a longer sloping walkway.

As shown in FIG. 8, the preferred embodiment may also be assembled to form a longer sloping walkway. It is noted that the first groove section 651 of the plank coupling groove 65 is a substantially V-shaped groove section having a largest width greater than twice a thickness of the rib structure. Therefore, the endmost first ribs 24 of two plank members 2 may simultaneously engage the first groove section 651 of the plank coupling groove 65 to form the longer sloping walkway.

Figure 9:
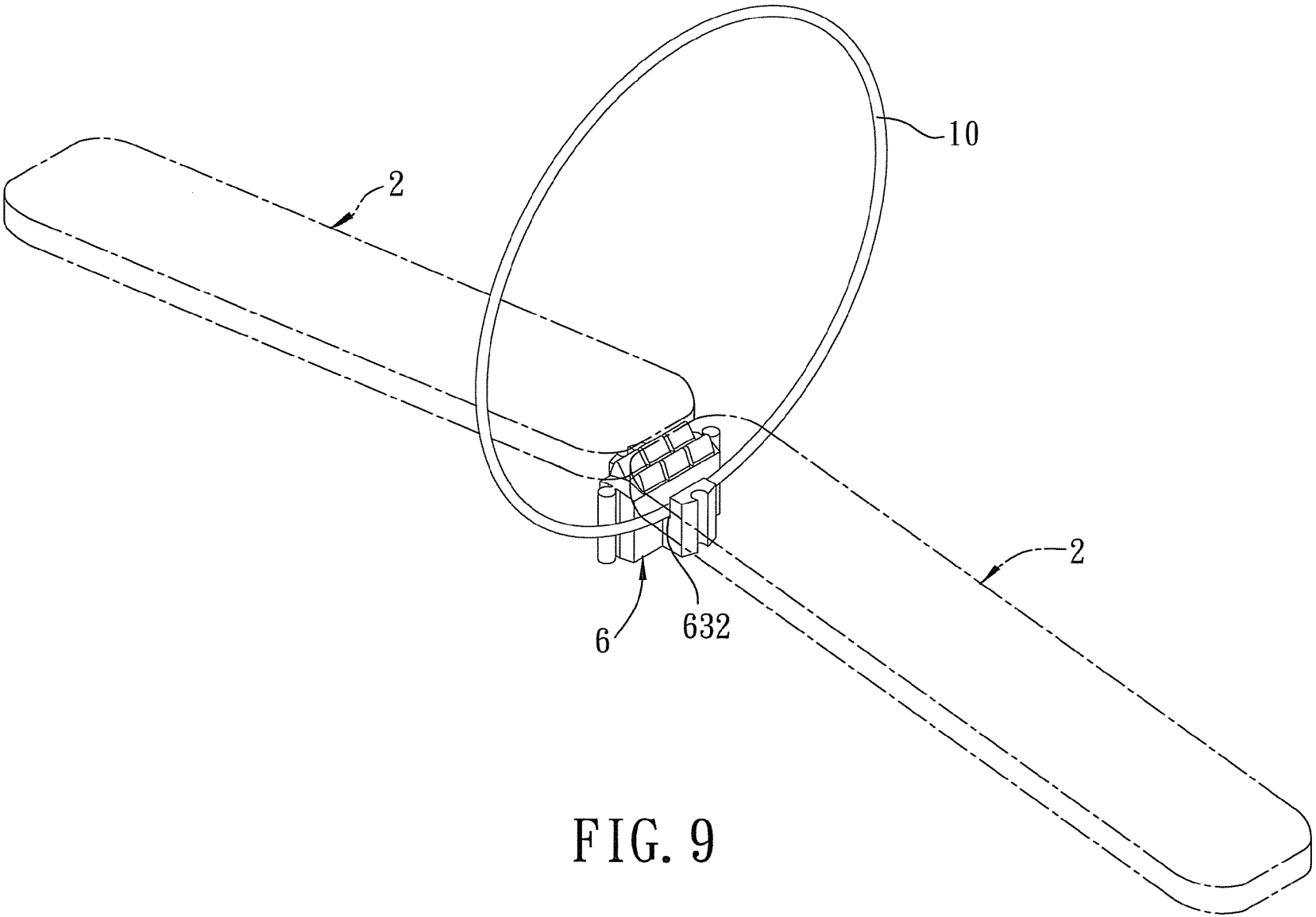
FIG. 9 is an assembled perspective view illustrating the supporting base with a hoop of the preferred embodiment according to the present invention.

Referring to FIGS. 5, 6 and 9, the balance training device of the preferred embodiment further includes a hoop 10. The supporting base 6 further has a rectangular lower base portion 61 connected to the plank connecting portion 62. The lower base portion 61 has opposite first lateral sides, each formed with a hoop engaging groove 632 to engage removably and selectively a part of the hoop 10. In the arrangement of FIG. 9, one of the plank members 2 is extended through the hoop 10 and engages the supporting base 6 after a part of the hoop 10 has engaged the hoop engaging groove 632. Therefore, aside from forming the longer sloping walkway shown in FIG. 8, inclusion of the hoop 10 provides greater amusement in view of the need to pass through the hoop 10 when traversing the balance training device.

Figure 10:
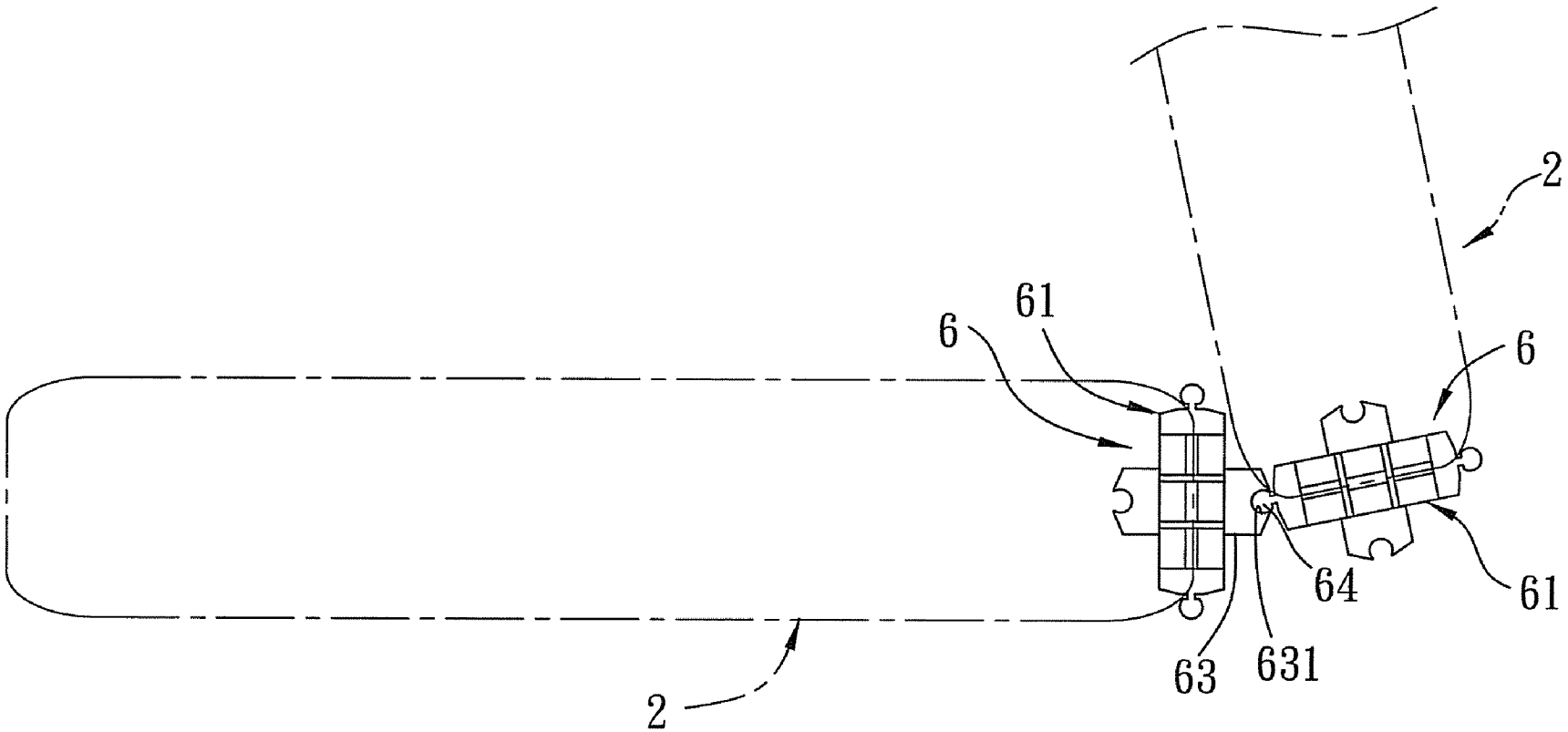
FIG. 10 is a top view illustrating an assembly of a pair of plank members and a pair of supporting bases of the preferred embodiment according to the present invention.

Referring to FIGS. 5, 6 and 10, each of the first lateral sides of the lower base portion 61 of the supporting base 6 is further formed with a first coupling element 63. The lower base portion 61 of the supporting base 6 further has opposite second lateral sides, each formed with a second coupling element 64 that complements the first coupling element 63. Accordingly, two supporting bases 6 may be coupled removably together so as to be pivotable relative to each other through engagement between the first coupling element 63 of one of the supporting bases 6 and the second coupling element 64 of the other one of the supporting bases 6. In this embodiment, the first coupling element 63 is a vertically extending female coupling element formed with a coupling groove 631 that is defined by an arcuate wall subtending an angle of about 240 degrees, and the second coupling element 64 is a vertically extending male coupling element.

Figure 11:
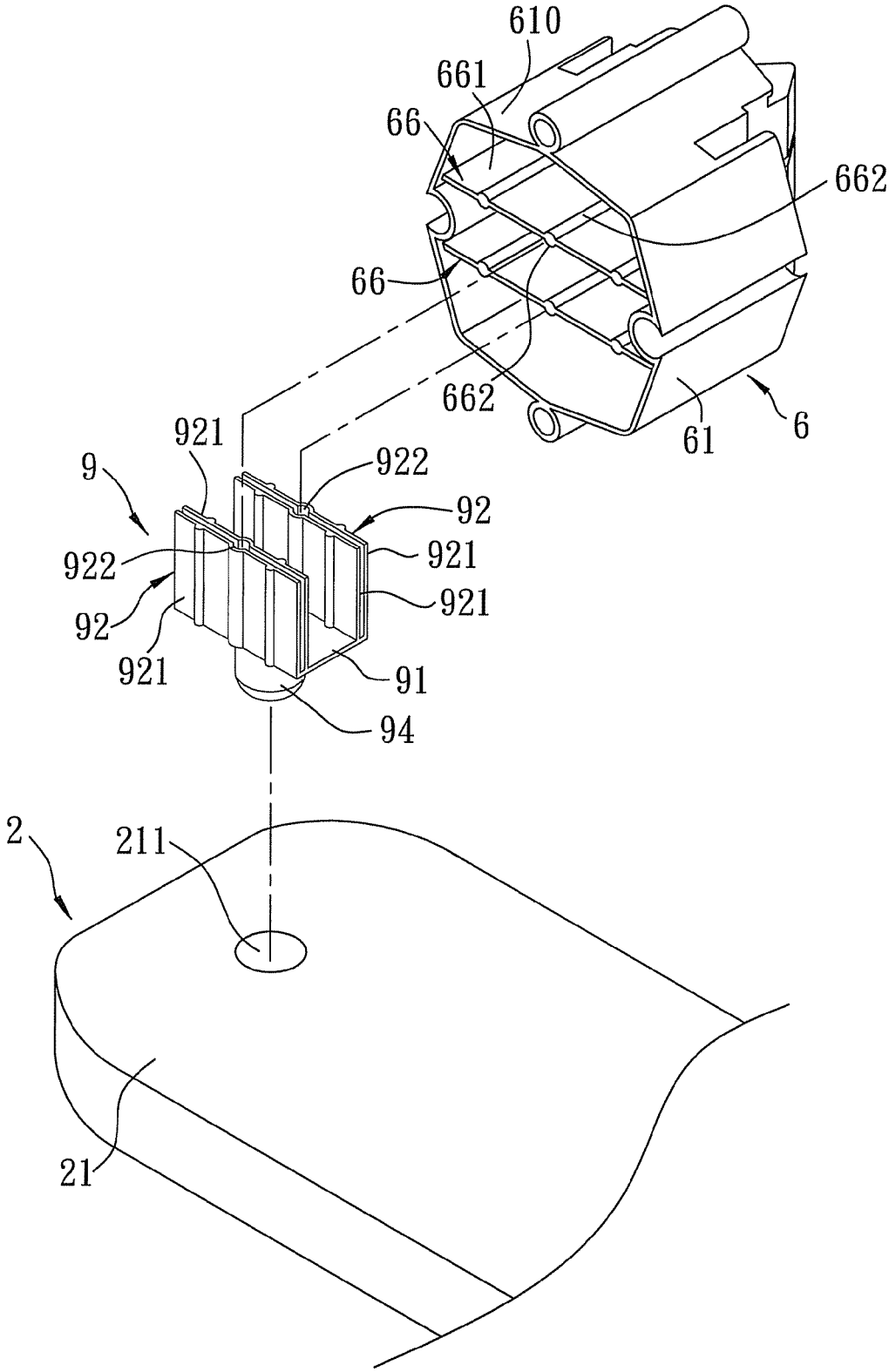
FIG. 11 is a fragmentary exploded perspective view illustrating the structures of the plank member, a coupling base and the supporting base of the preferred embodiment according to the present invention.
Figure 12:
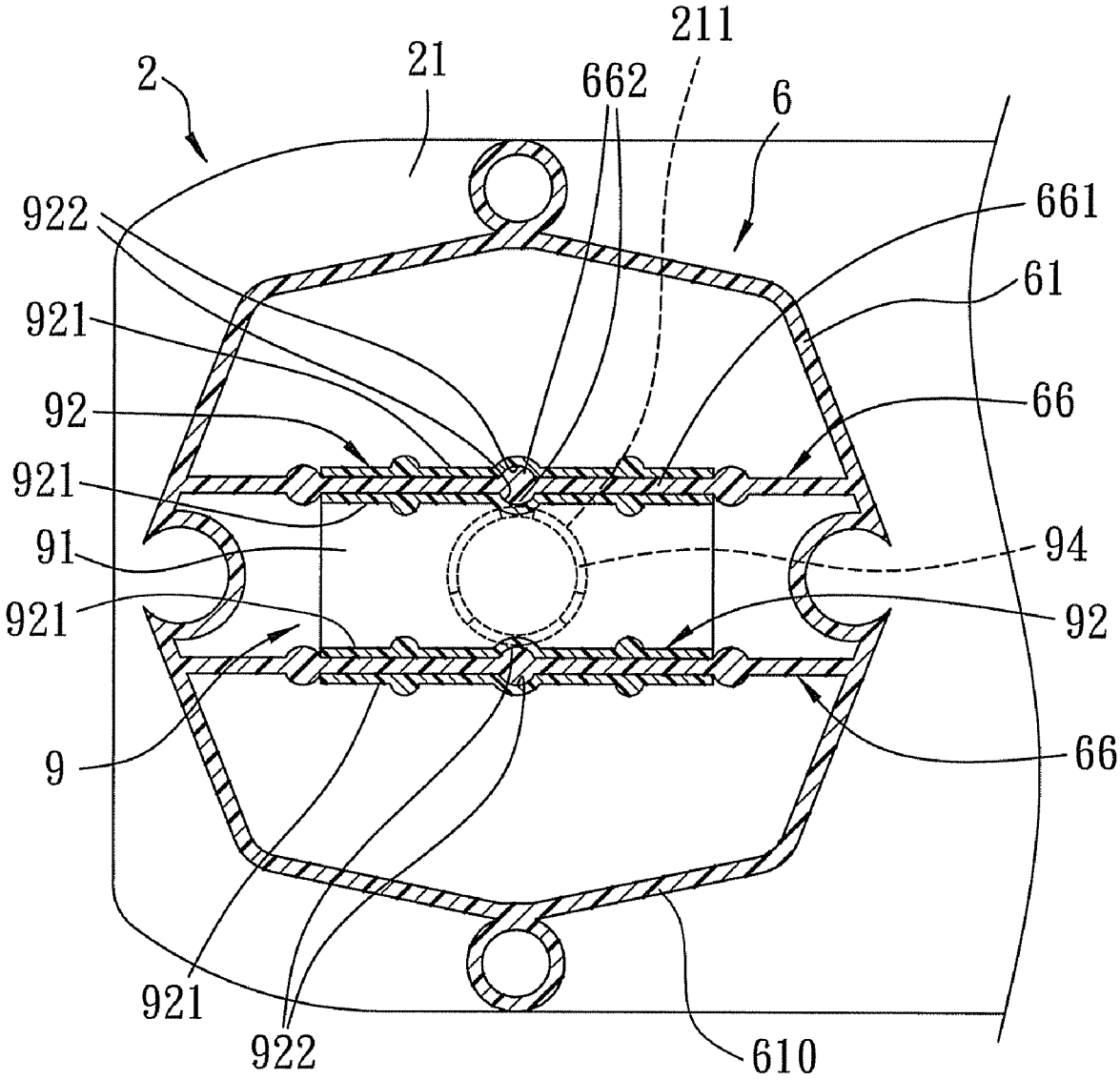
FIG. 12 is a fragmentary assembled sectional view illustrating an assembly of the plank member, the coupling base and the supporting base of the preferred embodiment according to the present invention.
Figure 13:
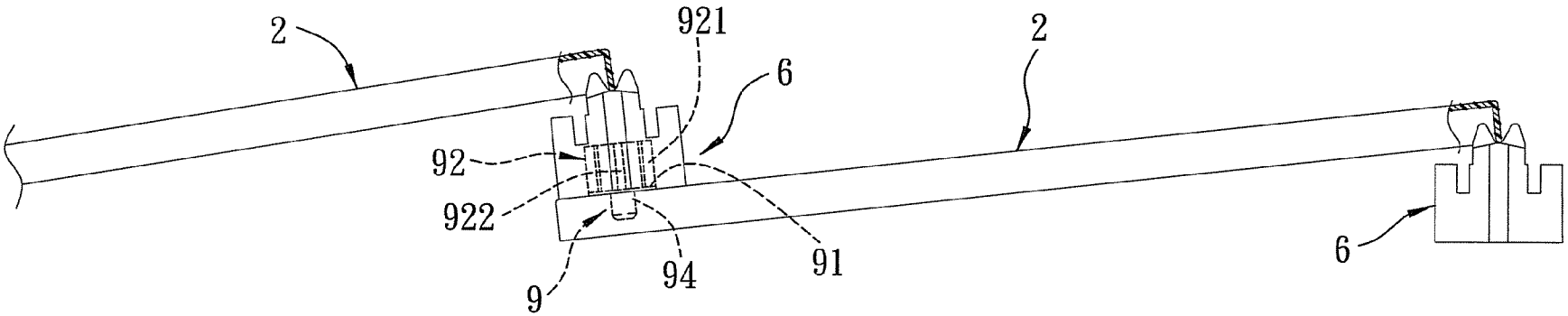
FIG. 13 is a fragmentary schematic partly sectional side view illustrating an assembly of a pair of the plank members, the coupling base and a pair of the supporting bases of the preferred embodiment according to the present invention.

Referring to FIGS. 11 to 13, the preferred embodiment further includes a coupling base 9 to couple removably the supporting base 6 to a top side of the plate portion 21 of the plank member 2. The lower base portion 61 of the supporting base 6 is hollow and has a surrounding wall 610 and a cross-plate 66 disposed to extend in the surrounding wall 610. Preferably, the lower base portion 61 has a pair of the cross-plates 66. Each cross-plate 66 has at least one surface 661 formed with a protrusion 662. Preferably, both surfaces 661 of the cross-plate 66 have three protrusions 662. The locations of the protrusions 662 on the two surfaces 661 correspond to each other.

The coupling base 9 includes a base plate 91 to be disposed on top of the plate portion 21 of the plank member 2, and a plate clamping portion 92 that extends upwardly from the base plate 91 and that is extendible into the surrounding wall 610 to clamp removably the cross-plate 66. Preferably, the coupling base 9 includes a pair of the plate clamping portions 92 to clamp removably and respectively the cross-plates 66. Each plate clamping portion 92 includes a pair of clamping plates 921. At least one of the clamping plates 921 has an inner plate surface formed with a recess 922 to engage a corresponding protrusion 662. Preferably, the inner plate surface of each clamping plate 921 is formed with the recess 922 to engage a middle protrusion 662 on a confronting surface 661 of the corresponding cross-plate 66.

The coupling base 9 also includes a coupling post 94 extending downwardly from the base plate 91. The plate portion 21 of the plank member 2 is formed with a post hole 211 at each end thereof for selective engagement with the coupling post 94.

As shown in FIG. 13, a first one of the plank members 2 is supported by a first one of the supporting bases 6 at one end and engages the coupling base 9 at the other end. The coupling base 9 couples the first one of the plank members 2 and a second one of the supporting bases 6. The second one of the supporting bases 6 supports one end of a second one of the plank members 2. In this manner, another form of a sloping walkway can be obtained.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A balance training device comprising:

at least one supporting base having a plank connecting portion formed with a plank coupling groove that opens upwardly, said plank coupling groove including a first groove section and a second groove section that intersects said first groove section; and at least one plank member having a plate portion and a rib structure disposed on a bottom face of said plate portion, said rib structure removably engaging said plank coupling groove and including a first rib part to engage said first groove section and a second rib part to engage said second groove section;

wherein said plank connecting portion of said supporting base is formed with a plurality of projecting parts arranged in a two-dimensional array that includes a plurality of rows and columns, said first groove section being defined by said projecting parts in an adjacent pair of said columns, said second groove section being defined by said projecting parts in an adjacent pair of said rows;

wherein said rib structure includes parallel first ribs that serve as said first rib part and parallel second ribs that serve as said second rib part, said first ribs cooperating with said second ribs to form a grid that defines a plurality of grid spaces to receive removably said projecting parts.

2. The balance training device as claimed in claim 1, wherein said plate portion of said plank member has a pair of longitudinal edges connected respectively to an endmost pair of said second ribs, and a pair of transverse edges connected respectively to an endmost pair of said first ribs.

3. The balance training device as claimed in claim 2, comprising a pair of said plank members, said first groove section being configured to receive an endmost one of said first ribs of each of said plank members simultaneously.

4. The balance training device as claimed in claim 1, wherein each of said projecting parts has an inclined inner surface that confronts said first groove section, said inclined inner surfaces of said projecting parts configuring said first groove section to diverge upwardly.

5. The balance training device as claimed in claim 1, wherein said first groove section is a substantially V-shaped groove section having a largest width greater than twice a thickness of said rib structure.

6. A balance training device comprising:

at least one supporting base having a plank connecting portion formed with a plank coupling groove that opens upwardly, said plank coupling groove including a first groove section and a second groove section that intersects said first groove section;

at least one plank member having a plate portion and a rib structure disposed on a bottom face of said plate portion, said rib structure removably engaging said plank coupling groove and including a first rib part to engage said first groove section and a second rib part to engage said second groove section; and a hoop, said supporting base further having a lower base portion connected to said plank connecting portion, said lower base portion having a lateral side formed with a hoop engaging groove to engage removably a part of said hoop.

7. A balance training device comprising:

a pair of supporting bases, each of said supporting bases having a plank connecting portion formed with a plank coupling groove that opens upwardly, said plank coupling groove including a first groove section and a second groove section that intersects said first groove section;

at least one plank member having a plate portion and a rib structure disposed on a bottom face of said plate portion, said rib structure removably engaging said plank coupling groove and including a first rib part to engage said first groove section and a second rib part to engage said second groove section; and each of said supporting bases further having a lower base portion connected to said plank connecting portion, said lower base portion having a first lateral side formed with a first coupling element, and a second lateral side formed with a second coupling element that complements said first coupling element such that said supporting bases are coupled removably together and are pivotable relative to each other through engagement between said first coupling element of one of said supporting bases and said second coupling element of the other one of said supporting bases.

8. The balance training device as claimed in claim 7, wherein said first coupling element is a vertically extending female coupling element, and said second coupling element is a vertically extending male coupling element.

9. The balance training device as claimed in claim 7, further comprising a hoop, said first lateral side of said lower base portion of each of said supporting bases being further formed with a hoop engaging groove to engage removably and selectively a part of said hoop.

10. A balance training device comprising:

at least one supporting base having a plank connecting portion formed with a plank coupling groove that opens upwardly, said plank coupling groove including a first groove section and a second groove section that intersects said first groove section;

at least one plank member having a plate portion and a rib structure disposed on a bottom face of said plate portion, said rib structure removably engaging said plank coupling groove and including a first rib part to engage said first groove section and a second rib part to engage said second groove section; and a coupling base for coupling removably one of said supporting bases to a top side of said plate portion of said plank member.

11. The balance training device as claimed in claim 10, wherein each of said supporting bases has a hollow lower base portion connected to said plank connecting portion, said lower base portion having a surrounding wall and a cross-plate disposed to extend in said surrounding wall;

said coupling base including a base plate to be disposed on top of said plate portion of said plank member, a plate clamping portion extending upwardly from said base plate and extendible into said surrounding wall to clamp removably said cross-plate, and a coupling post extending downwardly from said base plate;

said plate portion of said plank member being formed with a post hole for engaging said coupling post.

12. The balance training device as claimed in claim 11, wherein said cross-plate has at least one surface formed with a protrusion, and said plate clamping portion includes a pair of clamping plates, at least one of said clamping plates having an inner plate surface formed with a recess to engage said protrusion.

* * * * *